United States Patent [19]

Richards, III et al.

[11] 4,354,289

[45] Oct. 19, 1982

[54] WATERBED

[75] Inventors: Carl H. Richards, III, East Grand Rapids; Bruce H. Richards, Walker, both of Mich.

[73] Assignee: Richards Quality Bedding Company, Inc., Grand Rapids, Mich.

[21] Appl. No.: 139,608

[22] Filed: Apr. 11, 1980

[51] Int. Cl.[3] ..... A47C 27/00

[52] U.S. Cl. ..... 5/451

[58] Field of Search ..... 5/451, 452, 474

[56] References Cited

U.S. PATENT DOCUMENTS

| | | | |
|---|---|---|---|
| 3,456,270 | 7/1969 | Weinstein et al. | 5/451 |
| 4,145,780 | 3/1979 | Fogel | 5/451 X |
| 4,167,049 | 9/1979 | Fogel | 5/451 X |
| 4,186,455 | 2/1980 | Fox, Jr. | 5/474 X |
| 4,187,566 | 2/1980 | Peterson | 5/451 |
| 4,187,567 | 2/1980 | Crowther | 5/451 |
| 4,189,798 | 2/1980 | Vessey | 5/451 |
| 4,245,361 | 1/1981 | Evanson | 5/451 X |

*Primary Examiner*—Stephen J. Novosad
*Assistant Examiner*—George A. Suchfield
*Attorney, Agent, or Firm*—Blanchard, Flynn, Thiel, Boutell & Tanis

[57] ABSTRACT

A waterbed which is preferably substantially rectangular and has a substantially rigid base structure supporting a substantially rigid, but somewhat flexible, wall structure in which bladder means full of water is located so that the upper surface of the bladder is preferably about level with at least most of the upper edge of the wall structure. Liner means is placed between the bladder means and the wall structure in order to prevent leakage of fluid in the event that the bladder means is punctured. A zippered mattress cover is mounted upon the wall structure and covers the bladder means.

8 Claims, 5 Drawing Figures

WATERBED

FIELD OF THE INVENTION

This invention relates in general to a waterbed and, more specifically, to a type thereof which is relatively light in weight while providing maximum comfort and which is constructed so that it can be mounted upon a conventional metallic floor-engaging frame to which a headboard can be attached. Thus, the waterbed can be coordinated with other bedroom furniture of a conventional type.

BACKGROUND OF THE INVENTION

Completely comfortable and convenient use of waterbeds has previously been extensively limited by their excessive weight. Moreover, most previous waterbeds have not been capable of mounting upon existing base frames used with conventional spring and mattress combinations, nor capable of coordination with pieces of conventional bedroom furniture.

Accordingly, a primary object of this invention has been the provision of a waterbed construction which would provide all of the comforts of a conventional, but much heavier, waterbed construction while at the same time being adaptable to mounting upon a conventional base frame for a typical spring and mattress and to which a headboard can be attached.

A further object of this invention has been the provision of a waterbed construction, as aforesaid, which has the appearance of a conventional spring and mattress bed, which can utilize conventional water-containing bladder means, and which is relatively easy to maintain in a satisfactory appearance.

Other objects and purposes of this invention will become apparent to persons familiar with this type of equipment upon reading the following specification and examining the accompanying drawings in which.

For convenience in description, the terms "inner", "outer" and derivatives thereof will have reference to the geometric center of said waterbed and the parts thereof. The terms "upper", "lower" and words of similar import will have reference to the waterbed construction as appearing in FIG. 3. The terms "foot" and "head" shall have reference, respectively, to the left and right ends of the waterbed structure as appearing in FIGS. 1 and 3.

SUMMARY OF THE INVENTION

The objects and purposes of the invention, including those set forth above, have been met by providing a waterbed construction including a mattress support capable of mounting upon a conventional metallic base frame to which a headboard can be attached. A water mattress is supported upon the mattress support and includes a wall structure or shell having lateral wall means and a partial bottom wall means defining a central cavity into which a liquid receiving bladder is placed so that the upper surface of the bladder, when filled with a liquid, is approximately level with at least most of the upper edge of the sidewall means. The shell is contoured so that the central portion of the water mattress has a substantially greater water depth than the head and foot ends thereof, thereby providing more comfortable support for the often relatively heavier hip regions of the occupants of the bed.

DETAILED DESCRIPTION

Figure 1:
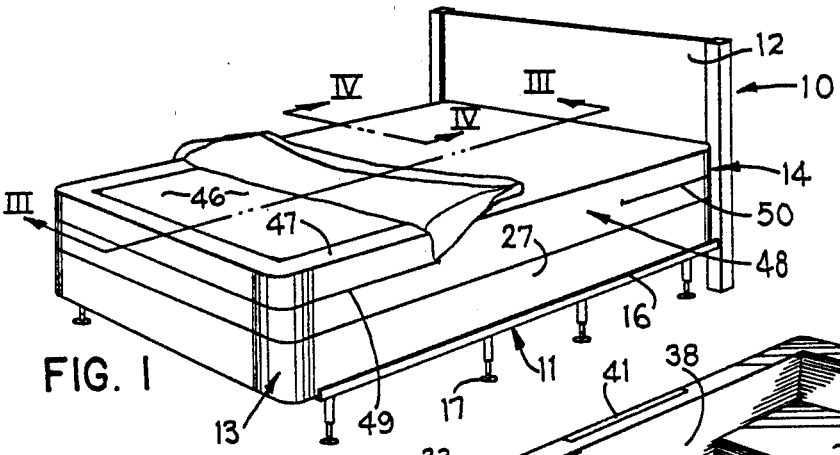
FIG. 1 is a perspective view of a waterbed embodying the invention.
Figure 2:
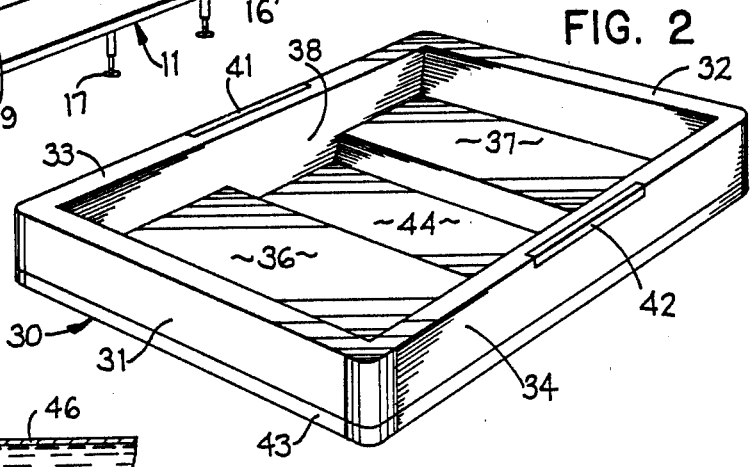
FIG. 2 is a perspective view of the wall construction of shell of the water mattress.
Figure 4:
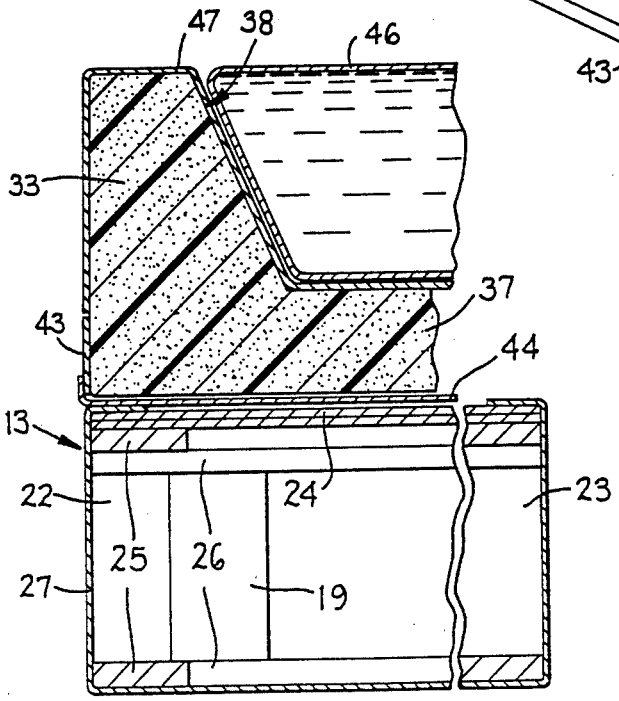
FIG. 4 is a sectional view taken along the line IV—IV in FIG. 1.
Figure 3:
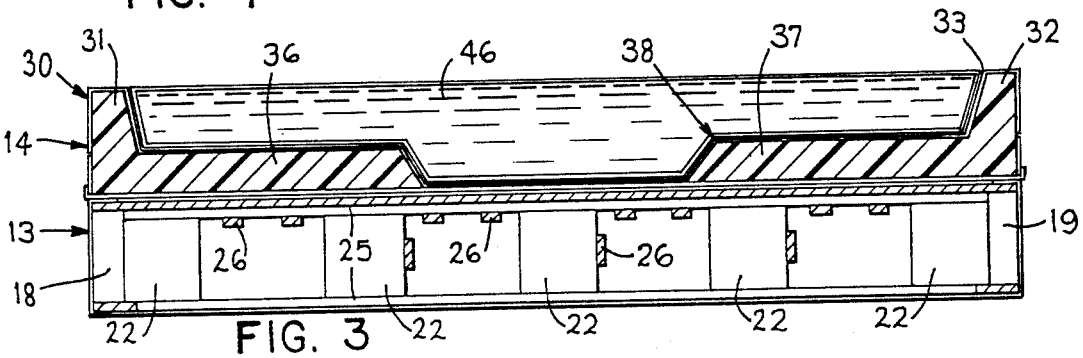
FIG. 3 is a sectional view taken along line III—III in FIG. 1.

The waterbed 10, a preferred embodiment of which is illustrated in FIGS. 1 and 3, is comprised of a base frame 11 having a conventional headboard 12 secured thereto, a mattress support 13 and a water mattress 14. The base frame 11 has a pair of spaced and parallel, metallic frame elements, one of which is shown at 16 in FIG. 1, which are each supported by a plurality of legs 17 and which are interconnected in a conventional manner by cross elements, not shown. The mattress support, FIGS. 3 and 4, has end blocks 18 and 19 and side blocks 22 and 23, FIGS. 3 and 2, respectively, said end blocks and side blocks being connected at their upper and lower ends by lengthwise and crosswise elements 25 and 26, respectively. A top wall 24, which may be fabricated from plywood or multiple thicknesses of corrugated cardboard, extends completely across and between the end blocks and side blocks. The lower ends of the side blocks 22 and 23 are supported by the frame elements 16. The sides and ends of the mattress support 13 are defined and covered by a decorative fabric 27 for appearance purposes.

Figure 5:
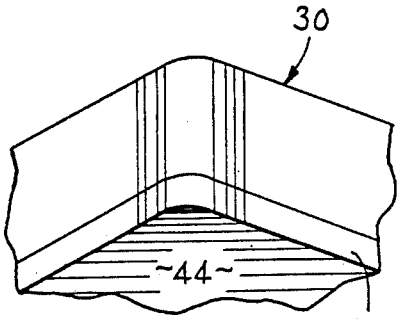
FIG. 5 is a fragment of the water mattress as viewed from one lower corner thereof.

The water mattress 14 is comprised of a unitary and somewhat flexible wall structure or shell 30 which is preferably fabricated from a foamed plastic, such as polyurethane. The wall structure includes end walls 31 and 32, FIG. 3, and sidewalls 33 and 34, FIGS. 4 and 5, respectively. The end walls and sidewalls are preferably substantially vertical on their outer faces, and their upper edges are preferably coplanar, as are their lower edges. The external shape of the shell is preferably rectangular, but it could, for example, be oval.

A pair of bottom wall portions 36 and 37 are integral with, and extend toward each other from, the foot end wall 31 and head end wall 32, respectively, adjacent the lower edges of said end walls (FIG. 3). The lateral edges of the bottom wall portions 36 and 37 are also integral with the adjacent parts of the sidewalls 33 and 34. Thus, the cavity 38 defined within the sidewalls, end walls and bottom wall portions of the wall structure 30 (FIG. 2) has a central portion which extends completely therethrough and two end portions which open upwardly.

Strips 41 and 42 (FIG. 2) of woven fabric, such as muslin, are secured as by an adhesive to the central portions of the upper outer edges of the sidewalls 33 and 34, respectively, for primary purposes discussed hereinafter. However, these strips also serve to strengthen the central portions of said sidewalls.

A band of woven fabric 43 is secured to the outer surfaces of the end walls and sidewalls of the structure 30 adjacent the lower edges thereof, also for strengthening purposes. A sheet of fabric 44 is secured as by stitching along its peripheral edge to the band 43 completely around the structure 30 to prevent, or at least vigorously oppose, outward deflection of the sidewalls 33 and 34 when the waterbed is in use. The inner surfaces of the sidewalls and end walls of the structure 30, as well as the opposing walls of the bottom portions 36 and 37, are tapered inwardly and downwardly to better accommodate the reception of the bladder 46 which is filled with a liquid, such as water, and disposed within the cavity 38.

Under normal circumstances, the bladder 46 is substantially rectangular in shape and accommodates itself to the contour of the recess 38 as the liquid seeks its own level within the cavity. However, under some circumstances, it may be advantageous to tailor the bladder to the precise internal shape of the cavity 38. The bladder 46 is fabricated from a sturdy but resiliently flexible material which is waterproof and can be flexed to accommodate the shape of the cavity 38.

A liner 47, which is also fabricated from a waterproof and resiliently flexible sheet material, is contoured so that it fits snugly within the cavity 38 and has an edge portion which extends over the upper edges of the side and end walls of the wall structure 30 and down the outsides of said walls, as to a point adjacent the band 43. This liner prevents the water or other liquid from leaving the mattress in the event that the baldder 46 is punctured.

A mattress cover 48, which is preferably made from a fabric like the fabric 27 on the mattress support 13, is contoured so that it extends completely over and around the sidewalls and end walls of the shell 30 with the bladder 46 disposed therein (FIG. 1). Zippers 49 and 50 are horizontally and preferably installed in the opposite end portions of the mattress cover so that they extend along the end walls thereof and partially along the sidewalls thereof, as shown in FIG. 1. Thus, the upper end portions of the mattress cover 48 can be folded back upon the mattress when the bladder is put into the wall structure 30 and thereby tucked carefully into all four corners of the structure to prevent voids at these corners.

The central portions of the side edges of the mattress cover 48 are secured, as by stitching, to the strips 41 and 42, thereby to prevent movement of the mattress either lengthwise or transversely of the shell 30 when the bed is being occupied.

OPERATION

The waterbed 10 is assembled by placing the mattress support 13 upon the base frame 11 in substantially the same manner that the springs of a conventional bed are placed upon such base frame. The water mattress 14, with an empty bladder, is then placed upon the top wall 24 of the mattress support and the two unzipped end portions of the mattress cover 48 are folded upon each other. The bladder is then filled with a liquid, such as water, through a conventional opening, not shown, in the upper surface thereof until the upper surface of the bladder is approximately even with the upper edge of the wall structure 30. During such filling of the bladder 46, it is maneuvered so that it substantially covers the bottom wall portions 36 and 37 and the opening therebetween.

The liner 47 will have been placed within the cavity 38 and around the outsides of the wall structure before the mattress cover is mounted upon the wall structure. The two upper end portions of the mattress cover 48 are then folded down over the ends of the wall structure and their zippers are closed, after which the waterbed is in condition for use.

In the preferred embodiment shown, the distance between the upper surfaces of the bottom portions 36, 37 and the upper edge of the side and end walls 31–34 is in the range of between four and six inches and the thickness of the bottom wall portions 36, 37 is in the range of between two and four inches; the bottom wall portions 36, 37 cover more than half but less than two-thirds of the area defined by the side and end walls 31–34; the waterbed 10 is queensized; and the mattress support 13, the shell 30, the bladder 46 filled with a liquid, the liner 47 and the cover 48 weigh between 800 and 950 pounds.

Although a particular preferred embodiment of the invention has been disclosed in detail for illustrative purposes, it will be recognized that variations or modifications of the disclosed apparatus, including the rearrangement of parts, lie within the scope of the present invention.

We claim:

1. A waterbed comprising:

a substantially rectangular and rigid support frame;

a resiliently flexible but substantially rigid, unitary and rectangular wall means having substantially parallel upper and lower edges, said wall means being mounted upon said support frame;

a pair of bottom wall portions integral with and extending inwardly from opposite parallel sides of said wall means, said portions having lower surfaces substantially coplanar with the lower edge of said wall means and having substantially parallel upper surfaces spaced from the upper edge of said wall means, said bottom portions extending toward but being spaced substantially from each other, said wall means and bottom portions bounding a cavity open at the top and open at the bottom between the opposed edges of said bottom portions;

band means extending completely around said wall means near the lower edge thereof;

flexible sheet means extending completely under said cavity, said bottom wall portions and said wall means, the periphery of said sheet means being secured to said band means along the length thereof, said sheet means closing the bottom of said cavity; and resiliently flexible bladder means containing a liquid and disposed within said cavity and bearing against said wall means, said sheet means and said bottom wall portions when the upper surface thereof is parallel with and near to the upper edge of said wall means.

2. A waterbed according to claim 1, wherein the distance between the upper surfaces of said bottom wall portions and the upper edge of said wall means is in the range of between four and six inches and wherein the thickness of said bottom wall portions is in the range of between two and four inches.

3. A waterbed according to claim 1, wherein said bottom wall portions cover more than half but less than two-thirds of the area defined by said wall means.

4. A waterbed according to claim 1, including strip means secured to the upper edges of the portions of said wall means between said bottom portions; flexible liner means covering the surfaces defining said cavity and extending over and downwardly along the upper and outer surfaces of said wall means; and flexible cover means extending across said bladder means and over the top and outer said surfaces of said wall means, said cover means having a zippered opening through which said bladder means can be inserted, portions of said cover means being secured to said strip means.

5. A waterbed according to claim 4, wherein said support frame includes a rigid rectangular base having legs, and a rigid rectangular support structure between said base and said wall means;

wherein said waterbed is queensized; and wherein said support structure, said wall means, said bladder means filled with a liquid, said liner means and said cover means weigh between 800 and 950 pounds.

6. A waterbed comprising:

a rigid support having a substantially planar upper surface;

a semi-rigid shell formed by upstanding unitary wall means closing the perimeter of a cavity and a pair of bottom wall portions integral with opposing parts of said upstanding wall means and underlying only portions of said cavity, said bottom wall portions extending toward each other but being spaced substantially apart in the central portion of the cavity which opens downwardly through the bottom of the shell, said upstanding wall means having a substantially planar bottom surface, said bottom wall portions having upper surfaces spaced below the upper edge of said upstanding wall means and substantially parallel with said bottom surface of said upstanding wall means;

flexible sheet means secured to said upstanding wall means adjacent the perimeter of the latter and extending therefrom completely under said central portion of said cavity and said bottom wall portions, said flexible sheet means closing the bottom of said central portion of said cavity; and liquid-tight bladder means disposed within said cavity and having a central portion adjacent said flexible sheet means, said bottom wall portion separating remaining portions of said bladder means from said flexible sheet means, said flexible sheet means supporting said shell and bladder means central portion on said rigid support.

7. A waterbed according to claim 6, wherein said bladder means is resiliently flexible and has respective upper and central bottom surfaces substantially coplanar with at least substantial portions of the upper and bottom, respectively, edges of said upstanding wall means when said bladder means is filled with liquid and disposed within said cavity for engagement with the upper surfaces of said bottom wall portions and said sheet means, and a flexible liner sheet lining said cavity beneath said bladder means and having a central portion engaging the central portion of said flexible sheet means.

8. A waterbed according to claim 6, wherein said shell is fabricated from a semiflexible foamed plastic material and said flexible sheet means being a fabric sheet and including an endless peripheral band of woven fabric surrounding said shell and secured to the outer surfaces of the upstanding wall means adjacent the lower edges thereof, the peripheral edge of said flexible sheet means being fixed to said band completely around said shell, so as to oppose outward deflection of said upstanding wall means when the waterbed is in use.

* * * * *

UNITED STATES PATENT AND TRADEMARK OFFICE

CERTIFICATE OF CORRECTION

PATENT NO. : 4 354 289

DATED : October 19, 1982

INVENTOR(S) : Carl H. Richards III, et al

It is certified that error appears in the above—identified patent and that said Letters Patent is hereby corrected as shown below:

Column 4, line 65; change "said surfaces" to ---side surfaces---.

Signed and Sealed this

*Twenty-sixth* Day of *April 1983*

[SEAL]

*Attest:*

GERALD J. MOSSINGHOFF

*Attesting Officer*

*Commissioner of Patents and Trademarks*